US005815826A

United States Patent [19]

Henderson et al.

[11] Patent Number: 5,815,826

[45] Date of Patent: Sep. 29, 1998

[54] METHOD FOR DETERMINING THE PRODUCTIVITY OF AN EARTH MOVING MACHINES

[75] Inventors: Daniel E. Henderson, Washington; Charlene L. Oliver; David A. Paul, both of Peoria, all of Ill.

[73] Assignee: Caterpillar Inc., Peoria, Ill.

[21] Appl. No.: 623,076

[22] Filed: Mar. 28, 1996

[51] Int. Cl.[6] ..... G01C 21/00

[52] U.S. Cl. ..... 701/50; 37/907; 701/201; 701/208

[58] Field of Search ..... 364/424.07, 424.04, 364/449.2, 449.7, 449.1, 423.098; 37/348, 907; 342/457, 357; 701/50, 35, 208, 201, 213, 207, 1

[56] References Cited

U.S. PATENT DOCUMENTS

| | | | |
|---|---|---|---|
| 4,035,621 | 7/1977 | Kemp | 235/151.3 |
| 4,542,461 | 9/1985 | Eldridge et al. | 364/424 |
| 4,831,539 | 5/1989 | Hagenbuch | 364/449 |
| 4,949,263 | 8/1990 | Jurca | 364/424.07 |
| 5,404,661 | 4/1995 | Sahm et al. | 37/348 |
| 5,438,771 | 8/1995 | Sahm | 37/348 |
| 5,493,494 | 2/1996 | Henderson | 364/424.07 |
| 5,631,658 | 5/1997 | Gudat et al. | 342/457 |
| 5,631,832 | 5/1997 | Hagenbuch | 364/424.04 |

*Primary Examiner*—Michael Zanelli
*Assistant Examiner*—Edward Pipala
*Attorney, Agent, or Firm*—James R. Yee; W. Bryan McPherson

[57] ABSTRACT

A method for automatically determining the productivity of an earthmoving machine in real time using an onboard computer. The earthmoving machine operates in cycles having a first portion and a second portion. The earthmoving machine moves in a first direction during the first portion and in a second direction during the second portion. The method includes the steps of detecting the starts of each cycle for a series of cycles, determining a machine parameter corresponding to each cycle, calculating a cycle parameter as a function of the machine parameter, and calculating at least one measure of productivity as a function of the cycle parameter.

14 Claims, 6 Drawing Sheets

| | FIRST EMBODIMENT | SECOND EMBODIMENT | THIRD EMBODIMENT |
|---|---|---|---|
| MACHINE PARAMETERS | TIME SPENT IN FIRST DIRECTION, TIME SPENT IN SECOND DIRECTION, TIME SPENT IN IDLE | START POSITION, END POSITION, HORIZONTAL DISTANCE, VERTICAL DISTANCE, SLOPE | SURFACE ELEVATIONS, TIME SPENT IN FIRST DIRECTION, TIME SPENT IN SECOND DIRECTION |
| CYCLE PARAMETERS | CUMULATIVE TIME SPENT IN FIRST DIRECTION, CUMULATIVE TIME SPENT IN SECOND DIRECTION, CUMULATIVE TIME SPENT IN IDLE, TOTAL NUMBER OF CYCLES | CUMULATIVE HORIZONTAL DISTANCE, CUMULATIVE VERTICAL DISTANCE, CUMULATIVE SLOPE | CUT VOLUME, FILL VOLUME, CUMULATIVE MOVING TIME |
| MEASURES OF PRODUCTIVITY | AVERAGE TIME SPENT IN FORWARD, AVERAGE TIME SPENT IN REVERSE, AVERAGE CYCLE TIME, NUMBER OF CYCLES PER HOUR | AVERAGE HORIZONTAL DISTANCE, AVERAGE SLOPE | VOLUME PER UNIT TIME |

400

Fig_4_

METHOD FOR DETERMINING THE PRODUCTIVITY OF AN EARTH MOVING MACHINES

TECHNICAL FIELD

The present invention relates generally to an earthmoving machine and, more particularly, to a method for determining the productivity of an earthmoving machine in real time.

BACKGROUND ART

Previously, in order to measure the productivity of earthmoving machines, time measurements had to be taken manually. For example, for an earthmoving machine which performs in cycles having first and second portions, the start and end of each cycle had to be measured with a stop watch. The average cycle time had then to be calculated using the manually recorded cycles times.

Other measures of productivity had to be measured in a similar manner.

The present invention is directed to overcoming one or more of the problems identified above.

DISCLOSURE OF THE INVENTION

In one aspect of the present invention, a method for automatically determining the productivity of an earthmoving machine in real time using an on board computer is provided. The earthmoving machine operates in cycles having a first portion and a second portion. The earthmoving machine moves in a first direction during the first portion and in a second direction during the second portion. The method includes the steps of detecting the start of each cycle for a series of cycles, determining a machine parameter corresponding to each cycle in the series of cycles, calculating a cycle parameter as a function of the machine parameter, and calculating a measure of productivity as a function of the cycle parameter.

In another aspect of the present invention, a method for automatically determining the productivity of an earthmoving machine in real time using an onboard computer is provided. The earthmoving machine operates in cycles having a first portion and a second portion. The earthmoving machine moves in a first direction during the first portion and in a second direction during the second portion. The method includes the steps of detecting the start of each first portion and the start of each second portion of each cycle for a series of cycles. The method further includes the steps of determining a first machine parameter corresponding to the first portion of each cycle in the series of cycles, calculating a first cycle parameter as a function of the first machine parameter, and calculating a first measure of productivity as a function of the first cycle parameter. The method further includes the steps of determining a second machine parameter corresponding to the second portion of each cycle in the series of cycles, calculating a second cycle parameter as a function of the second machine parameter, and calculating a second measure of productivity as a function of the second cycle parameter.

BRIEF DESCRIPTION OF THE DRAWINGS

FIG. 4 is a table illustrating the parameters used in the present invention for first, second, and third embodiments;

BEST MODE FOR CARRYING OUT THE INVENTION

Figure 1:
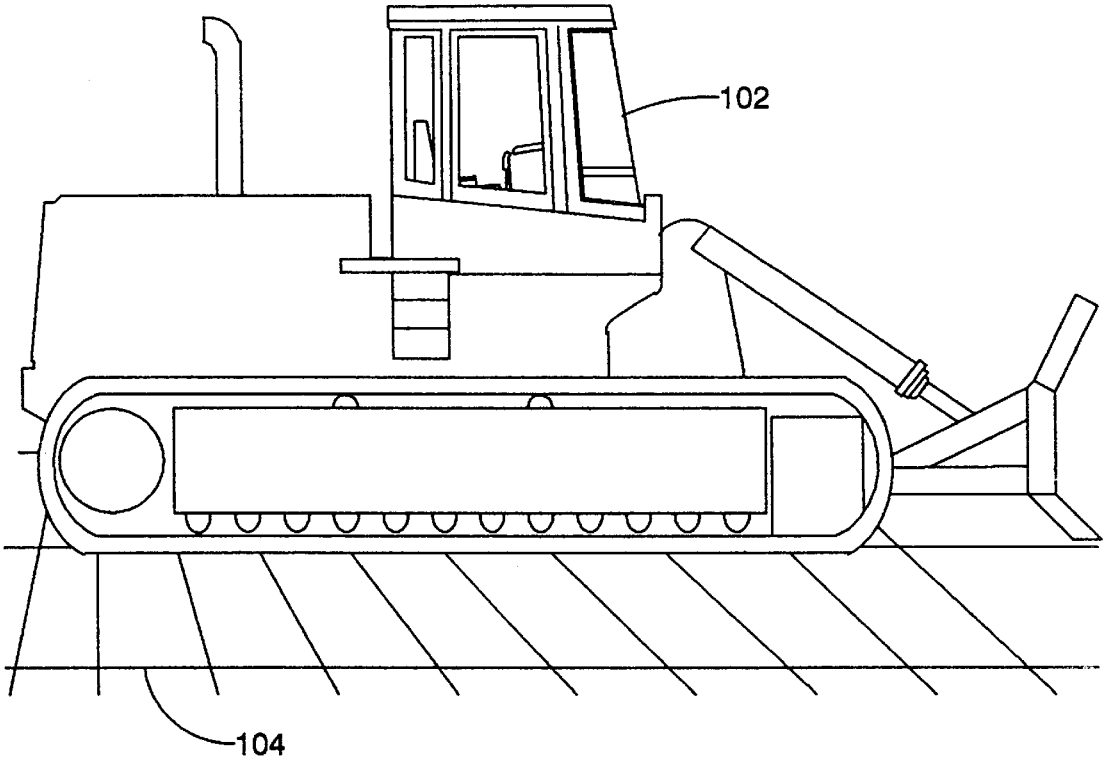
FIG. 1 is a graphical illustration of an earthmoving machine operated on a work site.
Figure 2:
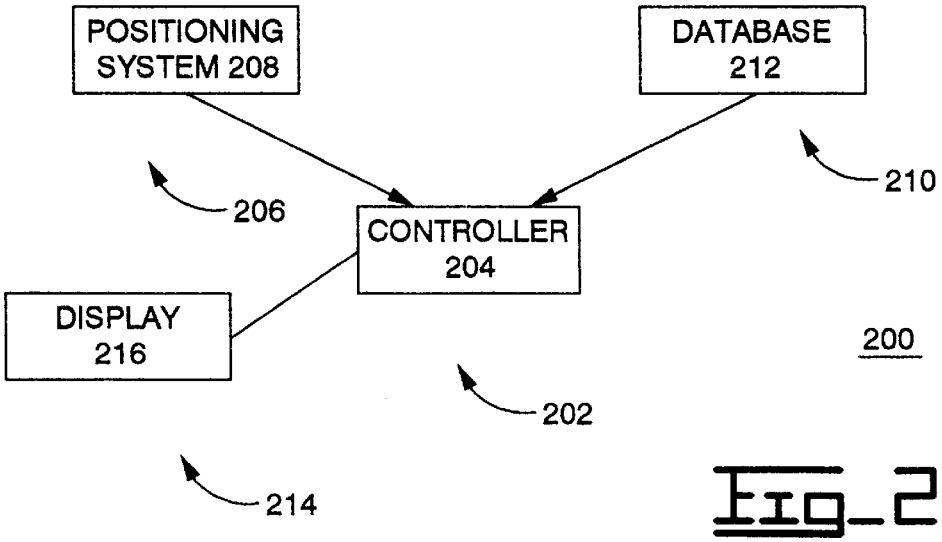
FIG. 2 is a block diagram of a system for providing a method for automatically determining the productivity of an earthmoving machine, according to an embodiment of the present invention.

With reference to FIG. 1, the present invention is adapted to provide a method for automatically determining the productivity of an earthmoving machine 102 in real time using an onboard computer. The earthmoving machine 102 operates on a work site 104. The earthmoving machine 102 operates in cycles having a first portion and a second portion. Generally, the earthmoving machine 102 moves in a first direction (forward) during the first portion and in a second direction (reverse) during the second portion. With reference to FIG. 2, the present invention or method is implemented by a controlling means 202. In the preferred embodiment, the controlling means 202 includes a microprocessor based controller 204.

A positioning means 206 provides measurements of the position of the earthmoving machines 102. The positioning means 206 includes a positioning system 208. In the preferred embodiment, the positioning system 208 includes a global positioning system (GPS) receiver (not shown). The GPS receiver receives signals from GPS satellites and uses these signals to determine the position of the earthmoving machine. The use of GPS receivers for determining the position of such machines is well known in the art and therefore not further discussed. It should be noted that other positioning systems, for example, laser based systems, dead-reckoning systems, or the like or combinations thereof may be substituted without departing from the spirit of the invention.

A database means 210 is used to store information relative to the site 104. Preferably, the database means 210 includes a database 212.

A display means 214 is used to display relevant information about the operator of the earthmoving machine 102 and/or the site 104 to an operator. Preferably, the display means 214 includes a display 216.

As stated above, the earthmoving machine 102 performs operations on the site 104 in a series of cycles. Preferably the cycles include a first portion in which the earthmoving machine 102 is moving in a forward direction and a second portion in which the earthmoving machine 102 is moving in a reverse direction.

Figure 3:
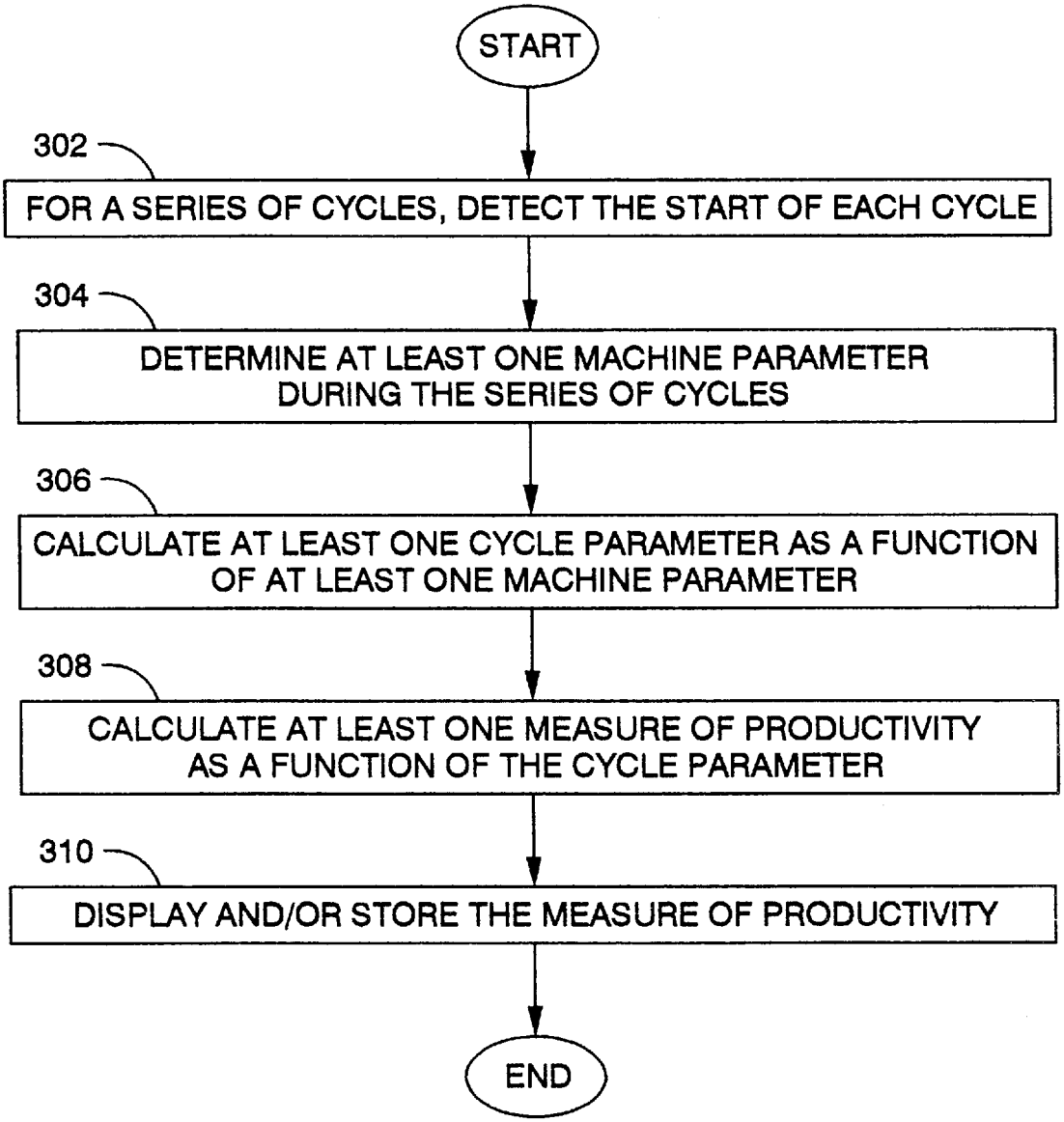
FIG. 3 is a flow diagram illustrating operation of the present invention.

With reference to FIG. 3, the general operation of the present invention will now be discussed. In a first control block 302 for a series of cycles, the start of each cycle is detected. In one embodiment, the start of each cycle may be detected by detecting a shift of the transmission of the earthmoving machine from a reverse direction to a forward direction. In an other embodiment the start of each cycle may be detected by comparing the path of the earthmoving machine 102 as defined by the position estimates received from the positioning means 206. In still another embodiment, the start of each cycle may be detected via an input button manually actuated by the operator.

In a second control block 304, at least one machine parameter is determined during each cycle.

In a third control block 306, at least one cycle parameter is calculated as a function of the machine parameter.

In a fourth control block 308, at least one measure of productivity is calculated as a function of the cycle parameter.

In a fifth control block 310, the measure of productivity is displayed or stored.

The method of the present invention will now be discussed in relation to three embodiments. In each of the three embodiments, different measures of productivity are calculated. As shown in the table 400 of FIG. 4, in each embodiment of different machine parameters are determined and different cycle parameters and measures of productivity are calculated.

Figure 5:
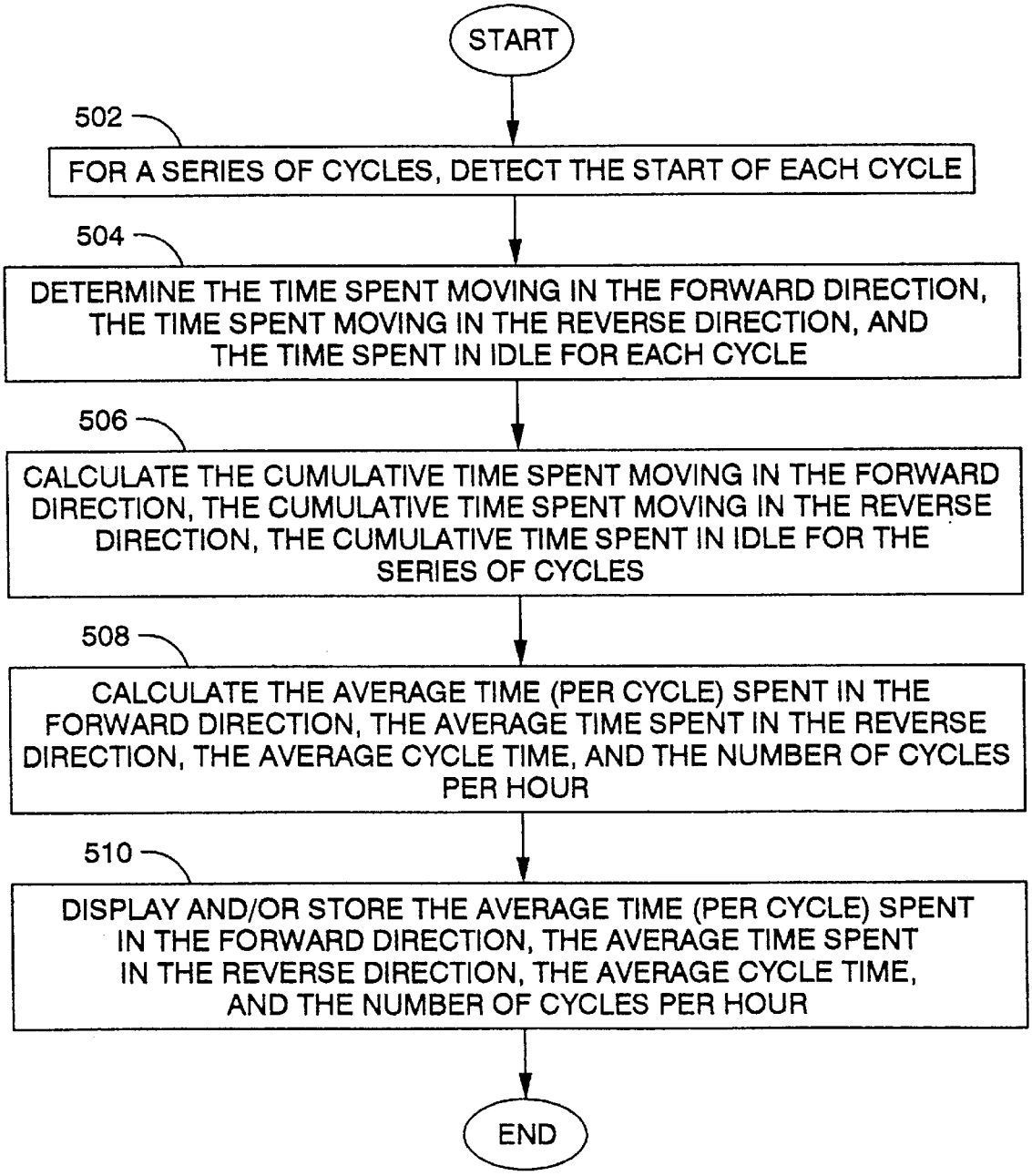
FIG. 5 is a flow diagram illustrating operation of the present invention according to the first embodiment.

With reference to FIG. 5, the first embodiment of the present invention will now be discussed. In a sixth control block 502, the start of each cycle in a series of cycles is detected.

In a seventh control block 504, the time spent moving in the forward direction, the time spent moving in the reverse direction, and the time spent in idle for each cycle in the series of cycles is determined. As discussed above, the start of each cycle may be detected via a number of methods. The start of the second portion of each cycle is detected in a similar manner. The time spent in idle for each cycle is determined as the difference between the total time of the current cycle, i.e. the time between the start of the current cycle and the time of the start of the next cycle, and the time spent moving in the forward and reverse directions.

In an eighth control block 506, the cumulative time spent moving in a forward direction, the cumulative time spent moving in the reverse direction, and the cumulative time spent in idle for the series of cycles is calculated.

In a ninth control block 508, the average time spent in the forward direction, the average time spent in the reverse direction, the average cycle time, and the number of cycles per hour are calculated.

The average time spent in the forward direction is equal to the cumulative time spent moving in the forward direction divided by the total number of cycles in this series.

The average time spent in the reverse direction is equal to the cumulative time spent moving in the reverse direction divided by the total number of cycles.

The average cycle time is calculated by adding the average time spent in the forward direction and the average time spent in the reverse direction.

The number of cycles per hour is calculated by dividing the total number of cycles by the sum of the cumulative time spent moving in the forward direction, the cumulative time spent moving in the reverse direction, and the cumulative time spent in idle for this series of cycles.

In a tenth control block 510, the average time spent in the forward direction, the average time spent in the reverse direction, the average cycle time and the number of cycles per hour are displayed on the display means 214 and/or stored.

Figure 6:
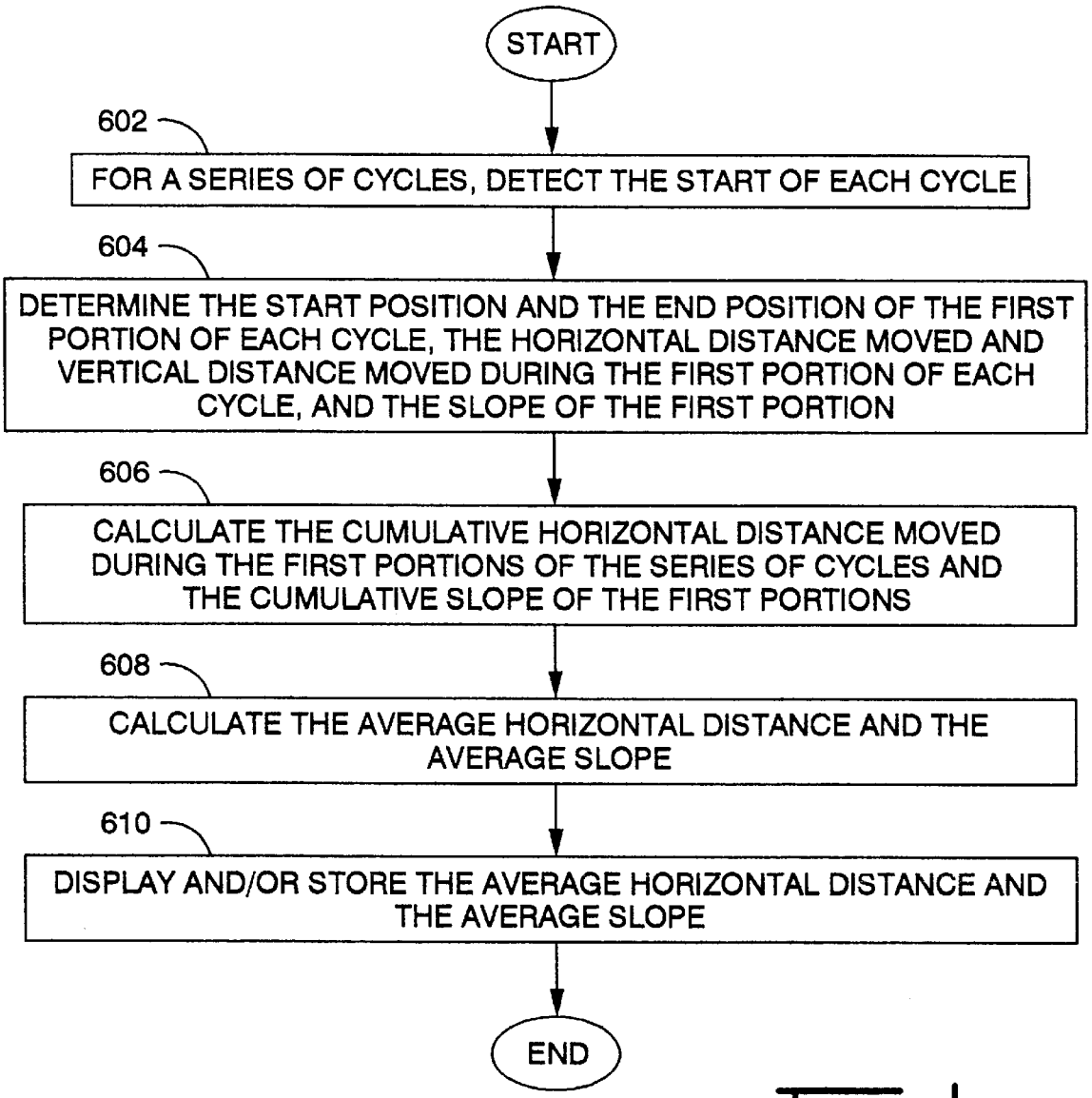
FIG. 6 is a flow diagram illustrating operation of the present invention according to the second embodiment.

With reference to FIG. 6, the operation of the present invention according to the second embodiment will now be discussed.

In an eleventh control block 602, the start of each cycle in a series of cycles is detected.

In a twelfth control block 604, the start position and the end position of the first portion of each cycle, the horizontal distance moved during the first portion of each cycle and the vertical distance moved during the first portion of each cycle are determined. Additionally, the slope of the first portion is determined. In the preferred embodiment, the start position of the first portion of each cycle is determined by the positioning system 208 and is represented by $(x_1,y_1,z_1)$ and the end position of the first portion of each cycle is also determined by the positioning system 208 and is represented by $(x_2,y_2,z_2)$.

Therefore, the horizontal distance moved during the first portion of each cycle is calculated by:

$$((x_1-x_2)^2+(y_1-y_2)^2)^{1/2} \qquad \text{Equation 1}$$

The vertical distance between the end position and the start position is determined by:

$$\text{Vertical distance}=z_1-z_2 \qquad \text{Equation 2}$$

The slope of the first portion is calculated by:

$$\text{Slope} = 100 \times \frac{\text{Vertical Distance}}{\text{Horizontal Distance}} \qquad \text{Equation 3}$$

In a thirteenth control block 606, the cumulative horizontal distance moved during the first portions of this series of cycles and the cumulative slope of the first portions are calculated as the sum of the horizontal distance moved during the first portions of the series of cycles and the slope of the first portions, respectively.

In a fourteenth control block 608, the average horizontal distance and the average slope are calculated. In the preferred embodiment, the average horizontal distance is calculated by:

$$\text{Average Horizontal Distance} = \frac{\text{Cumulative Horizontal Distance}}{\text{Number of Cycles}} \qquad \text{Equation 4}$$

The average slope is calculated by:

$$\text{Average Slope} = \frac{\text{Cumulative Slope}}{\text{Number of Cycles}} \qquad \text{Equation 5}$$

In a fifteenth control block 610, the average horizontal distance and the average slope are displayed and/or stored.

Figure 7:
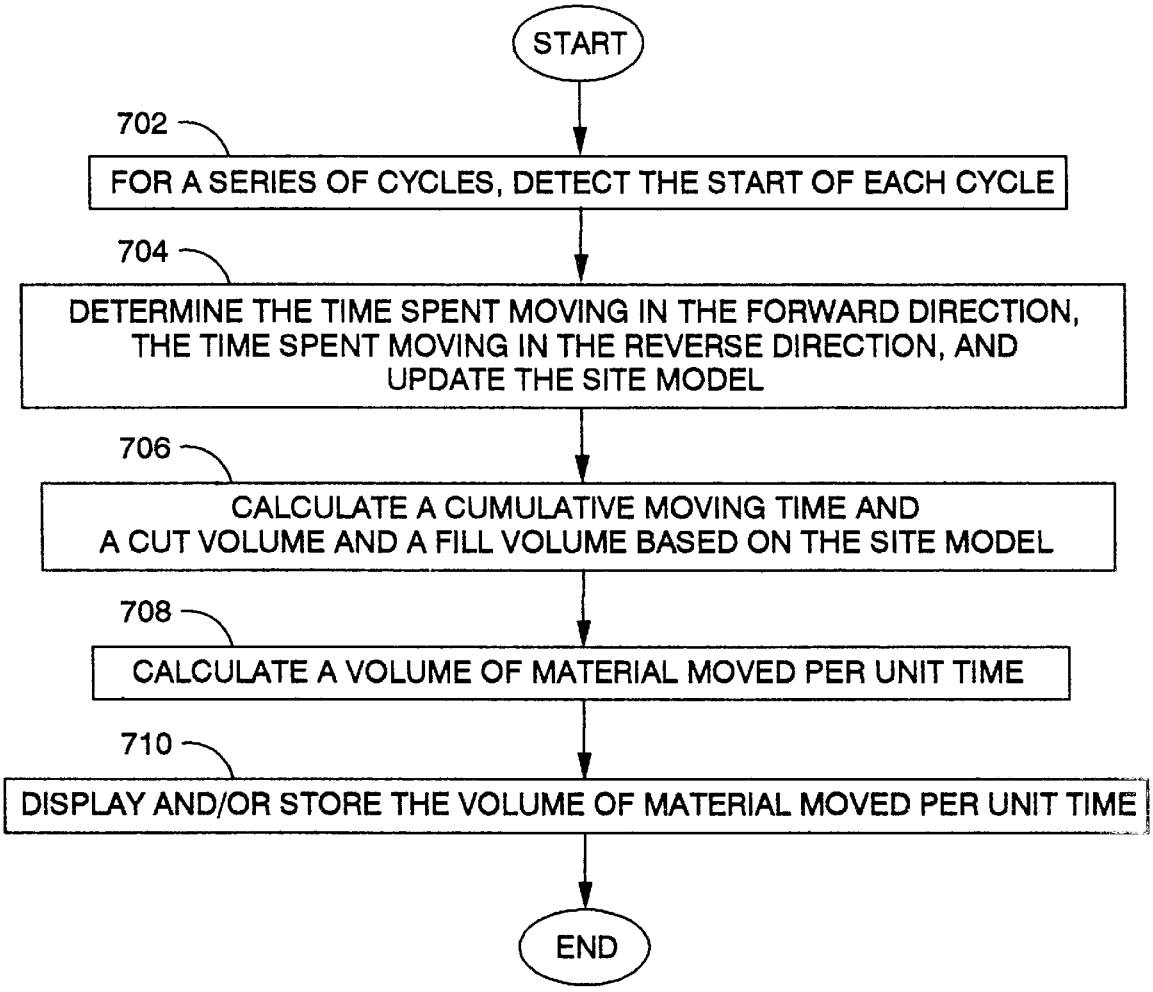
FIG. 7 is a flow diagram illustrating operation of the present invention according to the third embodiment.

With reference to FIG. 7, the operation of the present invention according to the third embodiment will now be discussed. In the preferred embodiment, the site 104 is represented by a site model within the database. The database includes a current site model and an initial site model. As the earthmoving machine 102 traverses the site 104, the positioning means 206 is used to measure the elevation of the site 104. In one embodiment, the site 104 is divided into squares with an associated elevation for each square. The database includes the elevation corresponding to each square.

Returning to FIG. 7, in a sixteenth control block 702, the start of each cycle for a series of cycles is detected.

In a seventeenth control block 704, the time spent moving in the forward direction and the time spent moving in the reverse direction during each cycle for the series of cycles is determined. Additionally, the current site model is updated using the elevations received from the positioning means 206.

In an eighteenth control block 706, a cumulative moving time is calculated as a function of the time spent moving in the forward direction and the time spent moving in the reverse direction for each cycle in the series of cycles. A cut volume and a fill volume based on the current site model and the initial site model are also determined.

In the preferred embodiment, the current elevation and the current site model for each square is compared with the initial elevation in the initial site model. Additionally, the difference in volume between the initial site model and the current site model for each square is determined based on the area of each square and the current and initial elevations.

In other words, the volume change in each square is calculated as the absolute value of the difference in elevation multiplied by the area of each square. Furthermore, the current elevation is compared with the initial elevation. If the current elevation is greater than the initial elevation for each square, then the volume difference for that square is added to a total fill volume. If, on the other hand, the current elevation is less than the initial elevation, then the current volume difference is added to the cut volume.

In a nineteenth control block 708, the volume of material moved per unit time is calculated. In the preferred embodiment, the volume of material moved per unit time is equal to the total cut volume divided by the cumulative moving time. In a twentieth control block 710, the volume of material moved per unit time is displayed and/or stored.

Industrial Applicability

With reference to the drawings in an operation, the present invention is adapted to provide a method for automatically determining the productivity of an earthmoving machine in real time using an onboard computer. The earthmoving machine operates in cycles having a first portion and a second portion. Generally, the earthmoving machine moves in a first direction during the first portion and in a second direction during the second portion. The earthmoving machine may be manually, semi-autonomously, or autonomously operated.

During each cycle, at least one machine parameter corresponding to that cycle is determined. At least one cycle parameter is calculated as a function of the machine parameter. At least one measure of productivity is calculated as a function of the one cycle parameter.

Operation of the present invention may be invisible to the operator. Data is sensed and determined during operation and the measures of productivity are determined automatically. The data may be stored onboard and/or displayed to the operator. Additionally, the data may also be transported offboard via a communication link or transported manually for computation of the means of productivity.

Other aspects, objects, and features of the present invention can be obtained from a study of the drawings, the disclosure, and the appended claims.

We claim:

1. A method for automatically determining the productivity of an earthmoving machine in real-time using an onboard computer, the earthmoving machine operating in cycles having a first portion and a second portion, the earthmoving machine moving in a first direction during the first portion and in a second direction during the second portion, comprising:

for a series of cycles, detecting the start of each cycle;

determining a start position of the earthmoving machine at the start of the first portion of each said cycle;

determining an end position of the earthmoving machine at the end of the first portion of each said cycle;

calculating a horizontal distance moved as a function of said start and end positions for each said cycle;

calculating a slope as a function of said start and end positions for each said cycle;

calculating a cumulative horizontal distance traversed;

calculating a cumulative slope traversed; and calculating a measure of productivity as a function of at least one of said cumulative horizontal distance and said cumulative slope traversed.

2. A method, as set forth in claim 1, wherein said step of calculating a measure of productivity includes the steps of:

calculating an average horizontal distance traversed as a function of said cumulative horizontal distance; and calculating an average slope traversed as a function of said cumulative slope.

3. A method, as set forth in claim 1, including the steps of:

determining the time the earthmoving machine spent in the first direction during said each cycle;

determining the time the earthmoving machine spent in the second direction during said each cycle;

determining the time the earthmoving machine spent in idle during said each cycle;

calculating the cumulative time the earthmoving machine spent in the first direction during said series of cycles;

calculating the cumulative time the earthmoving machine spent in the second direction during said series of cycles;

calculating the cumulative time the earthmoving machine spent in idle during said series of cycles;

calculating a number of cycles in said series of cycles;

calculating an average of the time the earthmoving machine spent moving in the first direction as a function of the cumulative time the earthmoving machine spent in the first direction during said series of cycles and said number of cycles;

calculating an average of the time the earthmoving machine spent in moving in the second direction as a function of the cumulative time the earthmoving machine spent in the second direction during said series of cycles and said number of cycles; and, calculating a number of cycles per hour and an average cycle time as a function of the cumulative time the earthmoving machine spent in the first and second directions during said series of cycles, the cumulative time the earthmoving machine spent in idle during said series of cycles and said number of cycles.

4. A method for automatically determining the productivity of an earthmoving machine in real-time using an onboard computer, the earthmoving machine operating in cycles having a first portion and a second portion, the earthmoving machine moving in a first direction during the first portion and in a second direction during the second portion, comprising:

for a series of cycles, detecting the start of each cycle;

determining a start position of the earthmoving machine at the start of the first portion of each said cycle;

determining an end position of the earthmoving machine at the end of the first portion of each said cycle;

calculating a horizontal distance moved as a function of said start and end positions for each said cycle;

calculating a cumulative horizontal distance traversed corresponding to said series of cycles; and calculating a measure of productivity as a function of said cumulative horizontal distance, said measure of productivity including an average horizontal distance.

5. A method for automatically determining the productivity of an earthmoving machine in real-time using an onboard computer, the earthmoving machine operating in cycles having a first portion and a second portion, the earthmoving machine moving in a first direction during the first portion and in a second direction during the second portion, comprising:

for a series of cycles, detecting the start of each cycle;

determining a start position of the earthmoving machine at the start of the first portion of each said cycle;

determining an end position of the earthmoving machine at the end of the first portion of each said cycle; and, calculating a slope as a function of said start and end positions for each said cycle;

calculating a cumulative slope traversed corresponding to said series of cycles; and calculating a measure of productivity as a function of said cumulative slope traversed, said measure of productivity including an average slope traversed.

6. A method for automatically determining the productivity of an earthmoving machine in real-time using an onboard computer, the earthmoving machine operating in cycles having a first portion and a second portion, the earthmoving machine moving in a first direction during the first portion and in a second direction during the second portion, wherein the earthmoving machine is operating at a site, the site being modelled in a database, the database including an initial site model and a current site model, the initial site model and the current site model including a series of elevations, comprising the steps of:

for a series of cycles, detecting the start of each cycle;

determining the time the earthmoving machine spent in the first direction during said each cycle;

determining the time the earthmoving machine spent in the second direction during said each cycle;

updating the current site model by determining current elevations as the earthmoving machine traverses the site;

calculating a cycle parameter as a function of said time spent in the first direction and second direction and said updated current site model, corresponding to said series of cycles; and calculating a measure of productivity as a function for said cycle parameter.

7. A method, as set forth in claim 6, wherein said step of calculating a cycle parameter includes the steps of:

calculating a cumulative cut volume as a function of the initial and current site models;

calculating a cumulative fill volume as a function of the initial and current site models; and, calculating a cumulative moving time as a function of the time the earthmoving machine spent in the first and second directions during said each cycle.

8. A method, as set forth in claim 7, wherein said step of calculating a measure of productivity includes the step of calculating the volume of material moved per time unit as a function of said cumulative cut volume, said cumulative fill volume, and said cumulative moving time.

9. A method, as set forth in claim 6, including the steps of:

determining the time the earthmoving machine spent in the first direction during said each cycle;

determining the time the earthmoving machine spent in the second direction during said each cycle;

determining the time the earthmoving machine spent in idle during said each cycle;

calculating the cumulative time the earthmoving machine spent in the first direction during said series of cycles;

calculating the cumulative time the earthmoving machine spent in the second direction during said series of cycles;

calculating the cumulative time the earthmoving machine spent in idle during said series of cycles;

calculating a number of cycles in said series of cycles;

calculating an average of the time the earthmoving machine spent moving in the first direction as a function of the cumulative time the earthmoving machine spent in the first direction during said series of cycles and said number of cycles;

calculating an average of the time the earthmoving machine spent in moving in the second direction as a function of the cumulative time the earthmoving machine spent in the second direction during said series of cycles and said number of cycles; and, calculating a number of cycles per hour and an average cycle time as a function of the cumulative time the earthmoving machine spent in the first and second directions during said series of cycles, the cumulative time the earthmoving machine spent in idle during said series of cycles and said number of cycles.

10. A method for automatically determining the productivity of an earthmoving machine in real-time using an onboard computer, the earthmoving machine operating in cycles having a first portion and a second portion, the earthmoving machine moving in a first direction during the first portion and in a second direction during the second portion, comprising:

(1) for a series of cycles, detecting the start of each first portion and the start of each second portion of each cycle;

(2) determining a first machine parameter corresponding to the first portion of said each cycle in said series of cycles;

(3) determining a second machine parameter corresponding to the second portion of said each cycle in said series of cycles;

(4) calculating a first cycle parameter as a function of said at least one first machine parameter;

(5) calculating a second cycle parameter as a function of said at least one second machine parameter;

(6) calculating a first measure of productivity as a function of said at least one first cycle parameter; and, (7) calculating a second measure of productivity as a function of said at least one second cycle parameter.

11. A method for automatically determining the productivity of an earthmoving machine in real-time using an onboard computer, the earthmoving machine operating in cycles having a first portion and a second portion, the earthmoving machine moving in a first direction during the first portion and in a second direction during the second portion, comprising:

for a series of cycles, detecting the start of each cycle;

determining a start position of the earthmoving machine at the start of the first portion of each said cycle;

determining an end position of the earthmoving machine at the end of the first portion of each said cycle;

calculating a horizontal distance moved as a function of said start and end positions for each said cycle;

calculating a cumulative horizontal distance traversed corresponding to said series of cycles; and calculating a measure of productivity as a function of said cumulative horizontal distance.

12. A method, as set forth in claim 11, wherein the step of calculating a measure of productivity further comprising the step of calculating an average horizontal distance traversed as a function of said cumulative horizontal distance.

13. A method for automatically determining the productivity of an earthmoving machine in real-time using an onboard computer, the earthmoving machine operating in cycles having a first portion and a second portion, the earthmoving machine moving in a first direction during the first portion and in a second direction during the second portion, comprising:

for a series of cycles, detecting the start of each cycle;

determining a start position of the earthmoving machine at the start of the first portion of each said cycle;

determining an end position of the earthmoving machine at the end of the first portion of each said cycle;

calculating a slope as a function of said start and end positions for each said cycle;

calculating a cumulative slope traversed corresponding to said series of cycles; and calculating a measure of productivity as a function of said cumulative slope traversed.

14. A method, as set forth in claim 13, wherein the step of calculating a measure of productivity further comprising the step of calculating an average slope traversed as a function of said cumulative slope traversed.

* * * * *